US006587657B2

(12) United States Patent
Sirejacob

(10) Patent No.: US 6,587,657 B2
(45) Date of Patent: Jul. 1, 2003

(54) SEALING MEMBER FOR TONER ASSEMBLY

(75) Inventor: Gino Sirejacob, Evergem (BE)

(73) Assignee: CF Technologies, Deinze (BE)

( * ) Notice: Subject to any disclaimer, the term of this patent is extended or adjusted under 35 U.S.C. 154(b) by 0 days.

(21) Appl. No.: 09/729,553

(22) Filed: Dec. 4, 2000

(65) Prior Publication Data

US 2001/0026706 A1 Oct. 4, 2001

Related U.S. Application Data

(60) Provisional application No. 60/168,993, filed on Dec. 3, 1999.

(51) Int. Cl.[7] ..... G03G 15/08; G03G 15/00

(52) U.S. Cl. ..... 399/106; 399/109

(58) Field of Search ..... 399/25, 102, 103, 399/105, 106, 109, 111, 119

(56) References Cited

U.S. PATENT DOCUMENTS

| | | | | | |
|---|---|---|---|---|---|
| 4,862,210 | A | * | 8/1989 | Woolley | 399/106 |
| 5,177,540 | A | | 1/1993 | Honda et al. | 355/260 |
| 5,304,269 | A | | 4/1994 | Jacaruso et al. | 156/94 |
| 5,621,508 | A | * | 4/1997 | McNamara | 399/106 |
| 5,718,044 | A | | 2/1998 | Baughman et al. | 29/890.1 |
| 5,781,831 | A | * | 7/1998 | Matsuzaki et al. | 399/119 |
| 5,826,140 | A | | 10/1998 | Zona et al. | 399/106 |
| 5,876,541 | A | | 3/1999 | Chitouras | 156/94 |
| 5,878,306 | A | | 3/1999 | Michlin | 399/106 |
| 5,930,559 | A | * | 7/1999 | De Kesel | 399/106 |
| 6,141,513 | A | * | 10/2000 | Nishiuwatoko et al. | 399/109 |
| 6,205,305 | B1 | * | 3/2001 | Suzuki et al. | 399/106 |

* cited by examiner

*Primary Examiner*—Sandra Brase
(74) *Attorney, Agent, or Firm*—Darby & Darby

(57) ABSTRACT

Parts of toner cartridges are attached by means of hot-melt means, so that the reconditioning of the toner cartridge is facilitated. The sealing member comprises a sealing film with hot melt means.

19 Claims, 4 Drawing Sheets

SEALING MEMBER FOR TONER ASSEMBLY

This patent application claims the priority of U.S. provisional patent application No. 60/168,993, filed on Dec. 3, 1999, which is incorporated herein by reference.

THE PRIOR ART

Up to now, the reconditioning of toner cartridges comprising a container attached to an element provided with a magnetic roller requires the mechanical separation of the toner container from the element bearing the magnetic for the replacement of the sealing member, the replacement of the sealing member by a new sealing member, and the mechanical and/or chemical attachment of the toner container and the element together.

Such a reconditioning is therefore time consuming and causes damages at each reconditioning step due to the mechanical separation of the container from the element bearing the magnetic roller.

The present invention aims to obviate these drawbacks.

BRIEF DESCRIPTION OF THE INVENTION

The invention relates to a member for sealing an opening of a container of a toner cartridge including an element provided with a roller for the transfer of toner particles, the element being adapted to be separated from the container. The member includes:

a film with central strip intended to be torn off;

a pulling member bound to the central strip;

means for attaching the sealing member on the toner cartridge so that the film seals the opening, and means adapted to extend between a surface of the container and a surface of the element provided with the roller, said means being provided with hot melt means adapted for attaching the toner container with the element.

Preferably, the means adapted to extend between a surface of the container and a surface of the element is a portion of the film.

The invention relates also to a process for reconditioning a toner cartridge, in which the toner container and the element provided with the roller are separated from each other. After removal of the remaining part of the sealing film from the container, a sealing member of the invention is attached on the container so as to ensure the sealing of the opening of the container. The element is placed with respect to the container so that the hot melt means are located between a surface of the element and a surface of the container. The element and container are then bound together by heating the hot melt means, by pressing the heated hot melt means between the element and the container, and by cooling the hot melt means while maintaining a pressure between the element and the container.

BRIEF DESCRIPTION OF THE DRAWINGS

The foregoing and other features of the present invention will be more readily apparent from the following detailed description and drawings of illustrative embodiments of the invention in which.

DESCRIPTION OF EMBODIMENTS OF THE INVENTION

Figure 1:
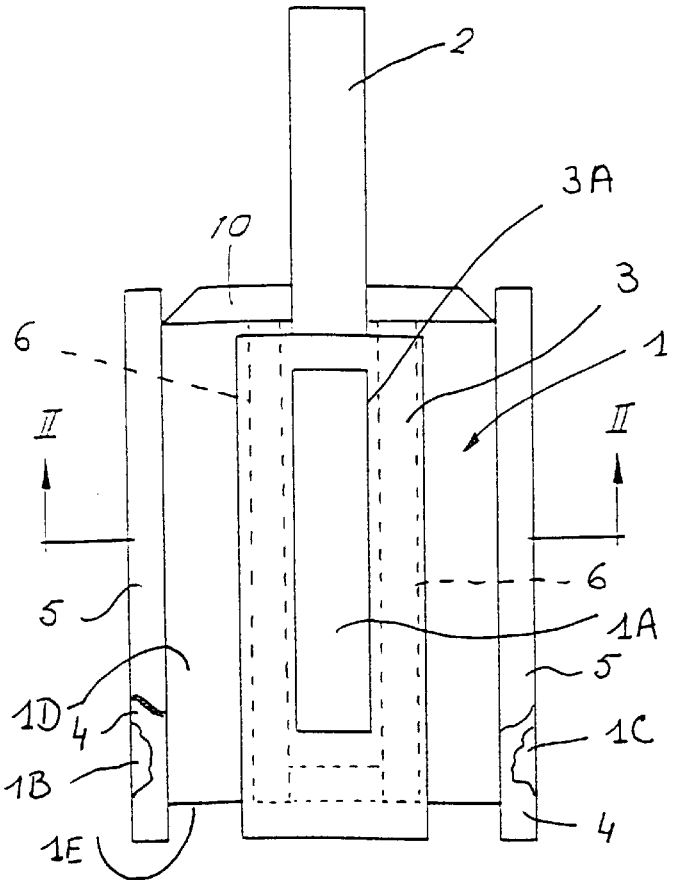
FIG. 1 is an upper view of a sealing member according to the invention.

A first object of the present invention is a member for sealing an opening of a toner container of a toner cartridge (for a laser printer, copy machine, printer, etc.), comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film;

means adapted to extend between a surface of the toner cartridge and a surface of the element provided with the roller, said means being provided with hot melt means, said hot-melt means being adapted for attaching the toner cartridge with the element.

Such a member is advantageously adapted so that as soon as the sealing film is correctly placed for sealing the opening of the toner cartridge, the hot-melt means are correctly placed with respect to the toner container, as well as with respect to the element bearing the magnetic roller when the element is placed correctly above the container, so that, when the element provided with the roller is placed against the toner container, the hot-melt means extends between a surface of the toner container and a surface of the element to be attached together.

According to an embodiment, the means adapted to extend between the surface of the toner cartridge and the surface of the element provided with the roller comprises at least a hot-melt strip, said strip being advantageously attached along an edge of the sealing film and preferably extending outside of said edge.

According to another embodiment, the means adapted to extend between the surface of the toner cartridge and the surface of the element provided with the roller is a part of the film provided with hot melt means. The hot-melt means can consist of hot-melt points, hot-melt lines, hot-melt chips extending through apertures of the film, etc. Advantageously, the means adapted to extend between the surface of the toner cartridge and the surface of the element provided with the roller is a part of the film provided with hot melt strip or layer.

According to a specific embodiment, the means adapted to extend between the surface of the toner cartridge and the surface of the element provided with the roller is a part of the film, said part having a first face intended to be directed towards the toner cartridge and a second face opposite to the said first face, the said two opposite faces being provided with hot melt means, preferably the said two opposite face being each provided with a hot-melt layer.

Advantageously the sealing member of the invention further comprises a heating element adapted for melting the hot melt means.

Such a heating element is an element which receives and/or conducts and/or generates heats when the element is provided with power, advantageously electrical power. The heat can also for example be induced by an electric field, for example a high frequency electric field. The heating element can be formed by the film it self, when the film is a metallized film, an aluminum film, a metal film, a film containing metal particles or fibres, etc.

Advantageously, the sealing member comprises electrical conducting means in contact with the hot-melt means, preferably an electrical conducting film in contact with the hot-melt means.

According to a possible embodiment, the hot melt means consists of a hot-melt composition containing electrical conducting element.

Advantageously, the sealing member of the invention further comprises a foam layer with a central passage, the sealing film being attached to said foam layer.

According a further advantageous detail of an embodiment of a sealing member of the invention, the sealing film is provided with gluing means for attaching the sealing film on a surface of the toner cartridge adjacent to the opening.

The invention relates also to a process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner cartridge, said sealing film with a central strip intended to be torn off being a part of a sealing member which at least further comprises: a pulling member bound to the central strip, and means adapted to extend between a surface of the toner cartridge and a surface of the element provided with the roller, said means being provided with hot-melt means, placing the element provided with the roller so that the hot-melt means of the sealing member extends between a surface of the toner cartridge and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner cartridge and the surface of the element provided with the roller, advantageously as long as the temperature of the hot-melt means reaches a temperature of at least 5° C., preferably at least 10° C., most preferably at least 20° C. below the softening point of the hot-melt means.

Advantageously, the sealing member is provided with a heating element, whereby the said step of heating the hot-melt means is carried out by providing power to the heating element. Preferably, the sealing member is provided with an electrical heating element, whereby the said step of heating the hot-melt means is carried out by providing electrical power to the heating element.

According to an embodiment, before the heating step, the process further comprises the step of attaching a heating element adjacent to the surface of the toner cartridge to be attached by the hot-melt means with the surface of the element provided with the roller and/or the step of attaching a heating element at least partly on the surface of the toner cartridge to be attached by the hot-melt means with the surface of the element provided with the roller and/or the step of attaching a heating element adjacent to the surface of the element provided with the roller to be attached by the hot-melt means with the surface of the toner cartridge and/or the step of attaching a heating element at least partly on the surface of the element provided with the roller to be attached by the hot-melt means with the surface of the toner cartridge and/or the step of attaching a first heating element adjacent to the surface of the toner cartridge to be attached by the hot-melt means with the surface of the element provided with the roller, and a second heating element adjacent to the surface of the element provided with the roller to be attached by the hot-melt means with the surface of the toner cartridge and/or the step of attaching a first heating element at least partly on the surface of the toner cartridge to be attached by the hot-melt means with the surface of the element provided with the roller, and a second heating element at least partly on the surface of the element provided with the roller to be attached by the hot-melt means with the surface of the toner cartridge.

When the heating element or means is attached to the toner container and/or the element, it is possible to use a sealing member provided with a heating element. The heating element to be attached to the toner container and/or the element can be attached by gluing means, for example glue adapted for resisting to high temperature and adapted for having an excellent adherence on the toner container and the element (silicone glue, isocyanate glue, polyurethane glue, etc.).

According to an embodiment of the process of the invention, the toner cartridge to be reconditioned comprises a toner container attached to the element provided with the roller by a hot-melt means and the toner cartridge is provided with a heating element for at least softening the hot-melt means, the separating step of the toner container from the element being at least carried out by providing power to the heating element for softening the hot-melt means.

The invention further relates to a doctor blade intended to be attached to a support of a toner cartridge, said doctor blade being provided with hot-melt means for attaching it on the support, said doctor blade comprising preferably also a heating element.

A further object of the invention is a process for reconditioning a toner cartridge provided with a doctor blade attached to an electrical conducting support by a hot-melt means, the said process comprising the following steps:

power is provided to the electrical conducting support for at least softening the hot-melt means;

the doctor blade is pulled away;

a doctor blade provided with hot-melt means is placed in contact with the support so that the hot-melt means is directed towards the support;

power is provided to the electrical conducting support for at least softening the hot-melt means of the doctor blade, and the doctor blade is pressed against the support so that the hot-melt means is pressed between the doctor blade and the support, and the hot-melt means is cooled, during at least a part of said cooling the hot-melt means is maintained pressed between the doctor blade and the support.

Still a further object of the invention is a process for reconditioning a toner cartridge provided with a doctor blade attached to a support by a hot-melt means, said doctor blade being provided with hot-melt means and a heating element for at least softening the hot-melt means, the said process comprising the following steps:

power is provided to the heating element for at least softening the hot-melt means;

the doctor blade is pulled away;

a doctor blade provided with hot-melt means and heating element is placed in contact with the support so that the hot-melt means is directed towards the support;

power is provided to the heating element for at least softening the hot-melt means of the doctor blade, and the doctor blade is pressed against the support so that the hot-melt means is pressed between the doctor blade and the support, and the hot-melt means is cooled, during at least a part of said cooling the hot-melt means is maintained pressed between the doctor blade and the support.

The invention further relates to a wiper blade intended to be attached to a support of a toner cartridge, said wiper blade being provided with hot-melt means for attaching it on the support. Advantageously, said wiper blade further comprises a heating element.

The invention relates therefore also to a process for reconditioning a toner cartridge provided with a wiper blade attached to an electrical conducting support by a hot-melt means, the said process comprising the following steps:

power is provided to the electrical conducting support for at least softening the hot-melt means;

the wiper blade is pulled away;

a wiper blade provided with hot-melt means is placed in contact with the support so that the hot-melt means is directed towards the support;

power is provided to the electrical conducting support for at least softening the hot-melt means of the wiper blade, and the wiper blade is pressed against the support so that the hot-melt means is pressed between the wiper blade and the support, and the hot-melt means is cooled, during at least a part of said cooling the hot-melt means is maintained pressed between the wiper blade and the support, as well as to a process for reconditioning a toner cartridge provided with a wiper blade attached to a support by a hot-melt means, said wiper blade being provided with hot-melt means and a heating element for at least softening the hot-melt means, the said process comprising the following steps:

power is provided to the heating element for at least softening the hot-melt means;

the wiper blade is pulled away;

a wiper blade provided with hot-melt means and heating element is placed in contact with the support so that the hot-melt means is directed towards the: support;

power is provided to the heating element for at least softening the hot-melt means of the wiper blade, and the doctor blade is pressed against the support so that the hot-melt means is pressed between the wiper blade and the support, and the hot-melt means is cooled, during at least a part of said cooling the hot-melt means is maintained pressed between the wiper blade and the support.

The sealing member of FIG. 1 comprises:

a sealing film 1 with a central strip 1A to be at least partly torn off, a pulling member 2 bound to the central strip 1A;

a foam element 3 provided with a central opening 3A, said opening being closed at least partly by the said central strip 1A;

electrical conducting elements 4, such as electrical conducting film having an electrical resistance so as to form a heating element when the conducting film is provided with electrical power, such film being for example a metal film (aluminum, copper, silver, gold, etc.) or a film containing electrical conducting particles and/or fibers; said elements 4 being located adjacent to the longitudinal 20 edges 1B,1C of the film, two elements 4 being placed on the upper face 1D of the film, while the two other are placed on the lower face 1E of the film; the elements being for example attached to the film by means of a glue, for example a self adhering glue or a two components glue;

hot-melt layers 5, each layer 5 covering at least partly a heating element 4, said layer being for example a layer applied on the heating element by depositing a fused hot-melt glue or by depositing a solution containing a hot-melt glue, and gluing means 6 on the lower face of the film and adjacent to the central portion 1A.

Figure 2:
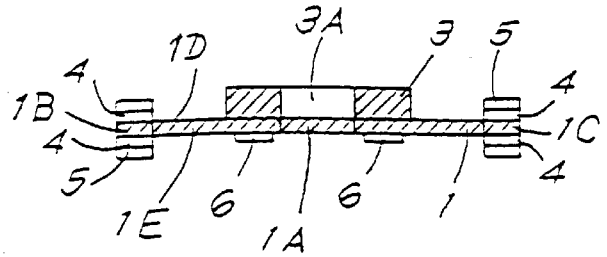
FIG. 2 is a cross section view along the line II—II of the sealing member of FIG. 1.

FIG. 2 is a cross-section view of the sealing member of FIG. 1.

Figure 3:
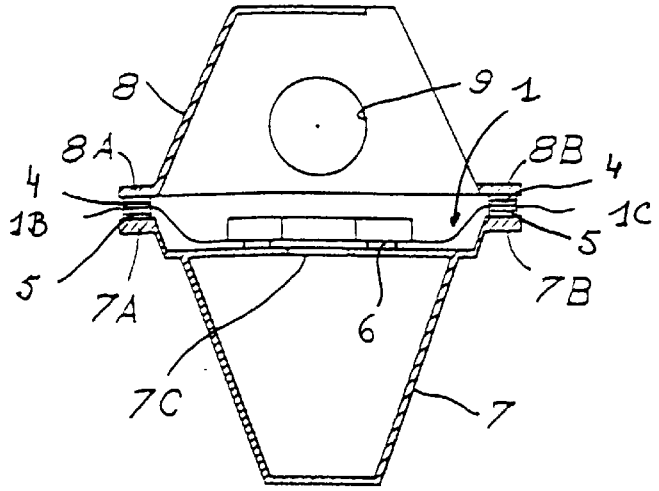
FIG. 3 is a schematic view showing the placement of the sealing member of FIG. 1 in a toner cartridge.

FIG. 3 shows schematically the placement of the sealing member of FIG. 1 between a toner container 7 and a supporting element 8 bearing the magnetic roller 9. After separating the container 7 away from the supporting element 8 and after removing the used sealing film, and possibly after a cleaning step, a sealing member 1 is attached to the container by means of the glue layer 6. The longitudinal edges of the sealing member and the hot-melt layers 5 of the sealing member extend then above or substantially above the two longitudinal surfaces 7A,7B of the container 7 intended to be contacted with the surfaces 8A,8B of the support element 8. The hot-melt layers 5 adjacent to the edge 1B of the sealing member extend between the surfaces 7A and 8A, while the hot-melt layers 5 adjacent to the edge 1C extend between the surface 7B and 8B. The surfaces 7A,8A and 7B and 8B are pressed together. Preferably a means acts substantially along the whole length of the surfaces for exerting a pressure on the hot-melt layers 5. Electrical power is now provided to the electrical conducting elements 4 so as to fuse the hot-melt (for example a temperature of 120–150° C. is reached by the heating element). When the hot-melt is fused, a good repartition of the hot-melt can be achieved due to the pressure exerted. While maintaining the pressure, the heating element are no more provided with electrical power and the hot-melt link is cooled up to a temperature of less than 50° C., for example up to the room temperature.

For the reconditioning of such a toner assembly, electrical power is provided to the heating elements 4 so as to fuse the hot-melt links so that the container 7 can be pulled away from the support 8 and so that the remaining parts of the film can be taken away by pulling on the film or on the foam element 3. (for example the film is provided with a pulling strip, which can be simply an extension of the film 1.

Figure 4:
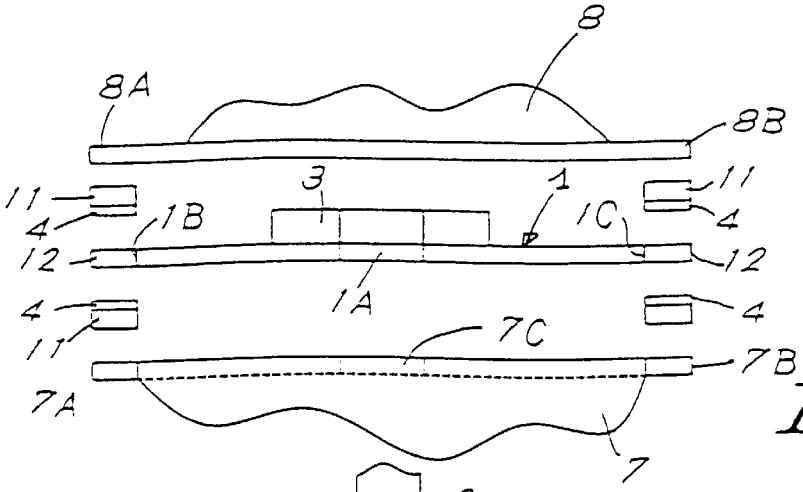
FIG. 4 is a cross section view of an embodiment of a sealing member of the invention, used with separate heating elements.

FIG. 4 is a cross-section view of a sealing member which is not provided with a heating element 4. In this embodiment, after separation of the container and the support 8 apart, the surfaces 7A,7B of the container are provided with heating elements 4, said heating elements being for example glued by means of a silicone glue, a high adhesive "glue, a two" glue or a two components glue, etc 11. In the same way, the 30 surfaces 8A,8B of the support are provided with heating elements 4.

The film 1 is provided along its two longitudinal edges 1B,1C with a hot-melt strip 12 adapted to extend between the surfaces 7A,8A and 7B,8B respectively when the sealing film is correctly placed for sealing the opening 7C of the toner container 7.

This form is advantageous as the sealing member has not to be provided with heating elements, as the adherence of the heating elements on the surfaces to be connected (7A,8A, 7B,8B) can be achieved by using high adherence glue, and as the surface of the heating element can have a pattern and/or a surface suitable for increasing or improving the adherence.

When using a sealing member not provided with a heating element, before heating the hot-melt means (layer), it is necessary to provide the surfaces 7A,7B,8A,8B with heating elements 4 in case the said surfaces are not already provided with such heating elements.

When using a film 1 such as an aluminum film or a metallized film in the embodiment of FIG. 4, separate heating means to be attached to the container and to the element bearing the magnetic roller is no more necessary.

Figure 5:
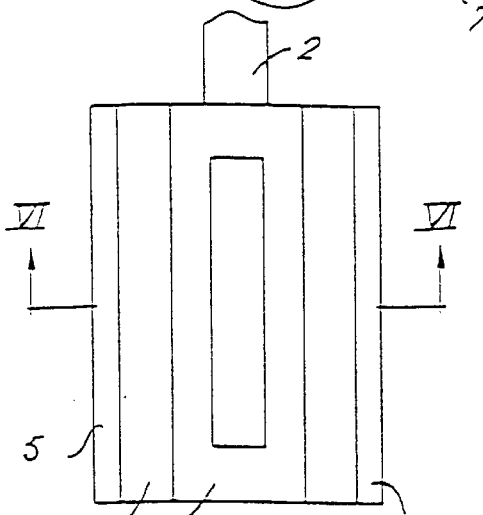
FIG. 5 is an upper view of a further embodiment of a sealing member of the invention.

The sealing member of FIG. 5 is similar to the sealing member of FIG. 4, except that, as for the sealing member of FIG. 1, the film 1 bears along its longitudinal edges the hot melt layers 5.

Figure 6:
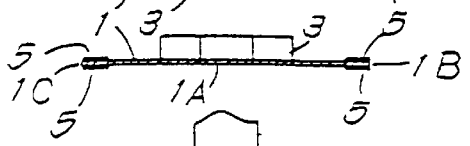
FIG. 6 is a cross section view along the line VI—VI of the sealing member of FIG. 5.

FIG. 6 is a cross-section view of the sealing member of FIG. 5.

Figure 7:
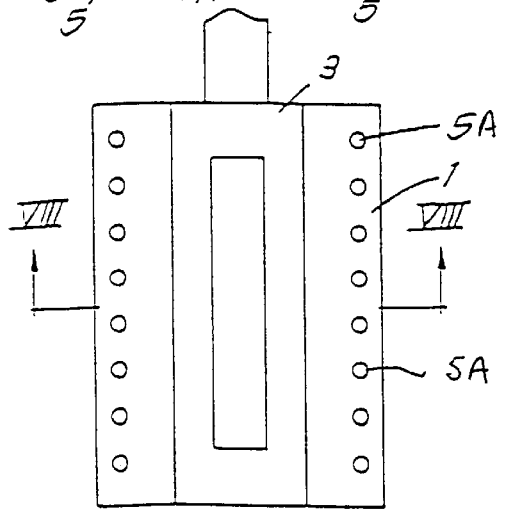
FIG. 7 is an upper view of still another embodiment of a sealing member of the invention.

The sealing member of FIG. 7 is similar to the sealing member of FIG. 5, except that the hot-melt is placed at different points 5A on the film 1, the hot-melt point being distant from each other. Advantageously, the points 5A are adapted so that when fusing and pressing the hot-melt points, substantially a continuous linking means is formed between the surfaces to be adhered.

Figure 8:
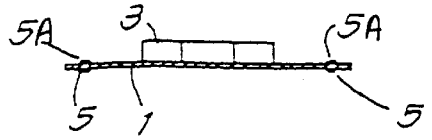
FIG. 8 is a cross section view along the line VIII—VIII of the sealing member of FIG. 7.

FIG. 8 is cross-section view of the sealing member of FIG. 7.

Figure 9:
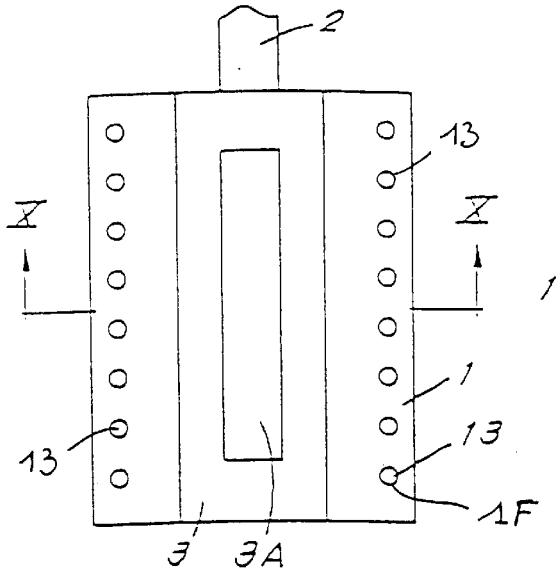
FIG. 9 is an upper view of still another further embodiment of a sealing member of the invention.

The sealing member of FIG. 9 is similar to the sealing member of FIG. 7, except that the film is provided with holes 1F in which extend at least partly hot-melt pins 13. When using such a form, the hot-melt pins can be fused by only one heating element 4 placed on a surface to be connected.

Figure 10:
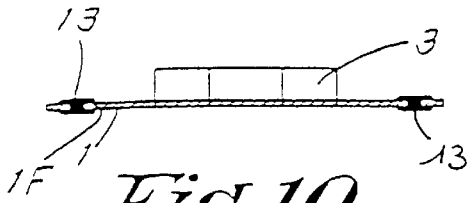
FIG. 10 is a cross section view along the line X—X of the sealing member of FIG. 9.

FIG. 10 is a cross-section view of the sealing member of FIG. 9.

Figure 11:
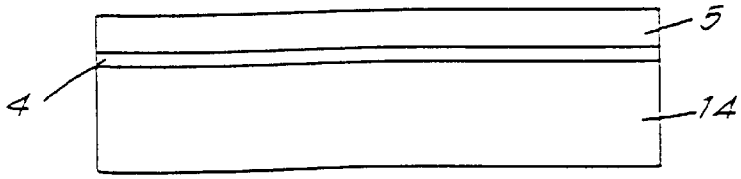
FIG. 11 is a schematic view of a blade of the invention.

FIG. 11 shows a blade, for example a doctor blade or a wiper blade 14 provided with an electrical heating layer 4 and a hot-melt layer 5. In case the support on which the blade has to be attached can act as heating element or is provided with a heating element, the blade 14 can only be provided with a hot-melt glue layer 5 (no heating element being then provided on the blade). The presence of a hot melt layer between the support and the blade, especially the doctor blade, was advantageous for improving the electrical isolation of the blade with respect to the support.

Figure 12:
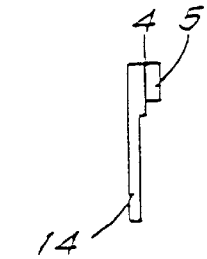
FIG. 12 is a cross section view along the line XII—XII of the blade of FIG. 11.

FIG. 12 is a cross-section view of the blade of FIG. 11.

Figure 13:
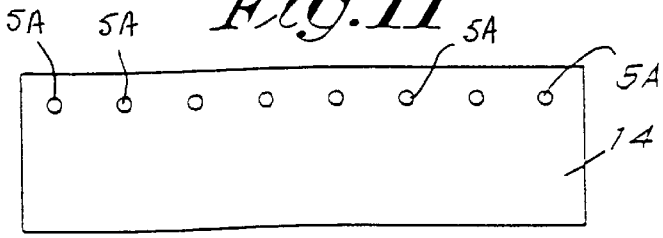
FIG. 13 is a schematic view of a further blade of the invention.

FIG. 13 shows a blade 14 provided with hot-melt means located at points 5A.

For reconditioning a toner cartridge provided with such a blade, electrical power is provided to the heating element 4 so as to fuse the hot-melt. The blade to be changed is then pulled away. A new blade is then positioned on the support and electrical power is provided to the heating element 4 so as to fuse the hot-melt. During said fusing the blade is pressed against the support. Thereafter the electrical power is switched off and the hot-melt link is cooled while maintaining the hot-melt under pressure.

Figure 14:
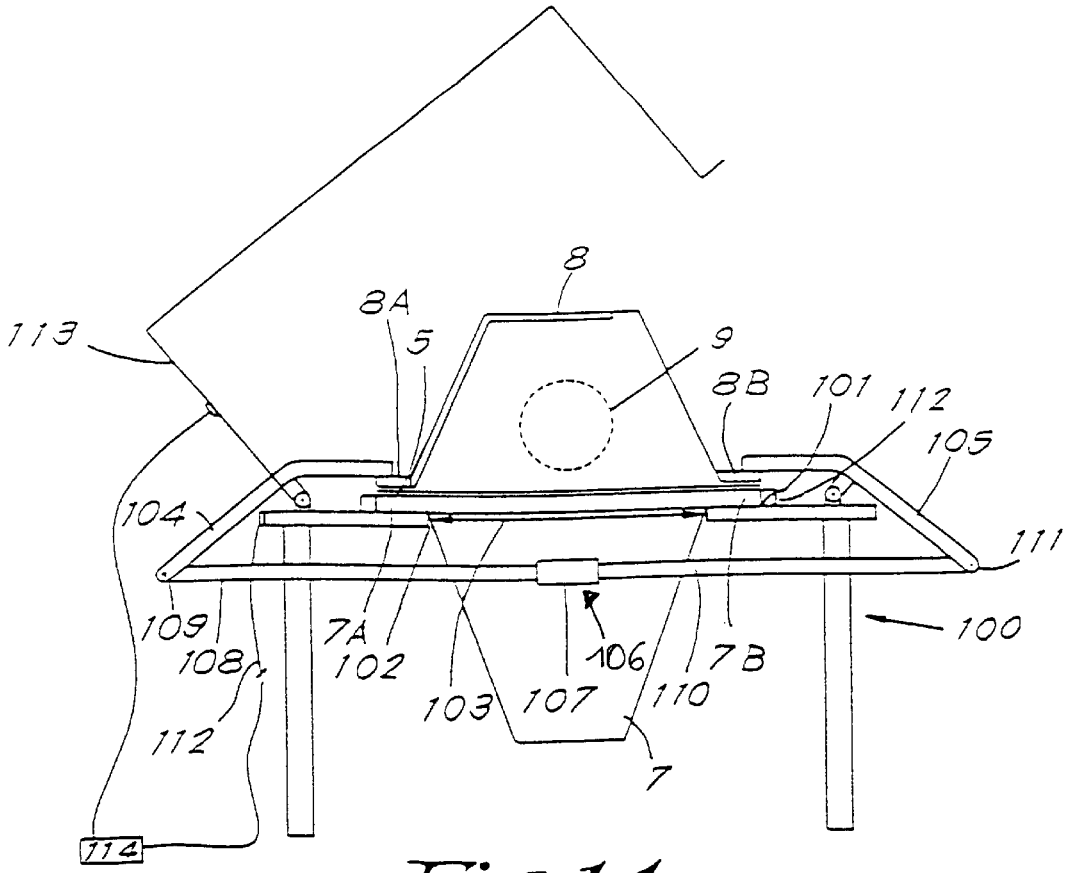
FIG. 14 is a schematic side view of an apparatus for the heat sealing of the toner cartridge.

FIG. 14 is a schematic view of a apparatus for reconditioning toner assembly. The apparatus comprises:

- a table 100 with a working surface 101 having an opening 102 for the passage of the container 7, the opening 102 having a breath 103 adapted so that the longitudinal edges of the container (provided with the surfaces 7A,7B) rest on the working table, the said opening 102 acting also as means for ensuring a correct position of the container 7;
- pressing arms 104, 105 for pressing the surfaces 8A,8B of the support 8, the said arms being pivotally mounted on the table 100;
- a system 106 for ensuring the movement of the arms so as to press surfaces of the container 7 on surface of the support 8, said system comprising for example a jack 107 attached to a rod 108 connected to the arm 104 by means of a pivot 109, the said jack 107 actuating a rod 110 connected by means of a pivot 111 to the arm 105, when the jack is actuated for moving the pivots 109,111 towards each other, the arms 104,105 are pivoted so as to not press the surfaces 8A,8B on the surfaces 7A,7B, while when the jack moves the pivots 109,111 away, the arms 104,105 pivot so as to press the surfaces 8A,8B on the surfaces 7A,7B;
- electrical conducting elements 112 intended to be connected to an electrical power source for providing electrical power to the heating elements (4) for fusing the hot-melt layer (5);
- a cover 113 pivotally mounted on the table 100, said cover acting as protection means during the fusing of the hot-melt,
- a control system 114 receiving an information when the cover 113 covers the toner assembly to be conditioned, and controlling when the cover 113 is its covering position, first the movement of the jack for pressing the surfaces 8A,8B on the surfaces 7A,7B with interposition with the film 1 and the hot-melt layers 5, and then the supply of electrical power (for example from a battery 12V) to the heating elements 4, the control system is advantageously provided with a timer so that the heating step is carried out in a predetermined time, and so that the movement of the arms 104,105 for no more pressing the surfaces 7A,7B,8A,8B the one on the other is actuated after a predetermined period after the end of the heating step (supply of electrical energy).

Figure 15:
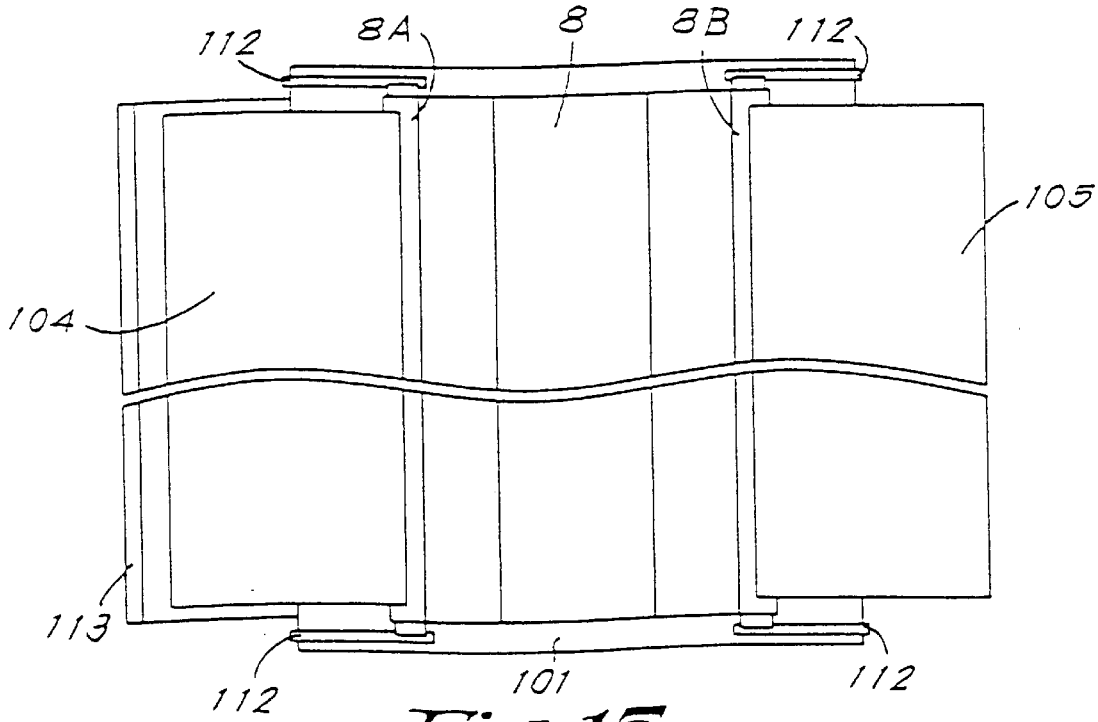
FIG. 15 is an upper view of the apparatus of FIG. 14.

FIG. 15 is a cross-section view of the apparatus of FIG. 14.

In all the examples, reference is made to an electrical element different from the hot-melt. In a possible embodiment, the hot-melt layer 5 can contain electrical conductive particles or/and fibers for heating and fusing the hot-melt.

Instead of heating the conducting element by supply of electrical power, it is also possible to supply heating energy to the conducting elements by means of a high frequency electric field (induction heating).

The hot-melt can be for example a nylon, nylon6-6, nylon 6, nylon 12, etc. or a hot melt adhesive varnish comprising a polyamide and a bismaleimide (EP0388847, the content of which is incorporated herein by reference), the hot-melts disclosed in EP0471251, in EP420246, in EP 306794, in EP 305851, in EP158086, the content of said documents being incorporated herein by reference.

What I claim is:

1. A member for sealing an opening of a toner container of a toner cartridge comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film; and means adapted to extend between a surface of the toner container and a surface of the element provided with the roller, said means being provided with hot-melt means, said hot-melt means being adapted for attaching the toner container with the element;

wherein the means adapted to extend between the surface of the toner container and the surface of the element provided with the roller is a portion of the film and is provided with the hot melt means.

2. The sealing member of claim 1, which further comprises a foam layer with a central passage, the sealing film being attached to said foam layer.

3. The sealing member of claim 1, in which the sealing film is provided with gluing means for attaching the sealing film on a surface of the toner cartridge adjacent to the opening.

4. A member for sealing an opening of a toner container of a toner cartridge comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film; and means adapted to extend between a surface of the toner container and a surface of the element provided with the roller, said means being provided with hot-melt means, said hot-melt means being adapted for attaching the toner container with the element;

wherein the means adapted to extend between the surface of the toner container and the surface of the element provided with the roller is a portion of the film and is provided with the hot melt means, the hot melt means being a hot-melt strip.

5. A member for sealing an opening of a toner container of a toner cartridge comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film; and means adapted to extend between a surface of the toner container and a surface of the element provided with the roller, said means being provided with hot-melt means, said hot-melt means being adapted for attaching the toner container with the element;

wherein the means adapted to extend between the surface of the toner container and the surface of the element provided with the roller is a portion of the film, said portion having a first face intended to be directed towards the toner cartridge and a second face opposite the first face, said first and second opposite faces being provided with the hot melt means.

6. A member for sealing an opening of a toner container of a toner cartridge comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film; and means adapted to extend between a surface of the toner container and a surface of the element provided with the roller, said means being provided with hot-melt means, said hot-melt means being adapted for attaching the toner container with the element;

wherein the means adapted to extend between the surface of the toner container and the surface of the element provided with the roller is a portion of the film, said portion having a first face intended to be directed towards the toner cartridge and a second face opposite the first face, said first and second opposite faces being provided with the hot melt means, the hot melt means being a hot-melt layer.

7. A member for sealing an opening of a toner container of a toner cartridge comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film;

means adapted to extend between a surface of the toner container and a surface of the element provided with the roller, said means being provided with hot-melt means, said hot-melt means being adapted for attaching the toner container with the element; and a heating element adapted for melting the hot-melt means.

8. A member for sealing an opening of a toner container of a toner cartridge comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film;

means adapted to extend between a surface of the toner container and a surface of the element provided with the roller, said means being provided with hot-melt means, said hot-melt means being adapted for attaching the toner container with the element; and electrical conducting means in contact with the hot-melt means.

9. A member for sealing an opening of a toner container of a toner cartridge comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film;

means adapted to extend between a surface of the toner container and a surface of the element provided with the roller, said means being provided with hot-melt means, said hot-melt means being adapted for attaching the toner container with the element; and electrical conducting film in contact with the hot-melt means.

10. A member for sealing an opening of a toner container of a toner cartridge comprising an element provided with a roller for the transfer of toner particles, said element being adapted to be separated from the said toner container, in which the member for sealing comprises at least:

a film with a central strip intended to be torn off;

a pulling member bound to the central strip;

means for attaching the sealing member on the toner cartridge so that the opening of the toner cartridge is sealed by the film; and means adapted to extend between a surface of the toner container and a surface of the element provided with the roller, said means being provided with hot-melt means, said hot-melt means being adapted for attaching the toner container with the element; wherein the hot-melt means includes a hot-melt composition having electrical conducting elements.

11. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein the sealing member is provided with a heating element, and whereby the said step of heating the hot-melt means is carried out by providing power to the heating element.

12. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein the sealing member is provided with an electrical heating element, and whereby the said step of heating the hot-melt means is carried out by providing electrical power to the heating element.

13. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein, before the heating step, the process includes the step of attaching a heating element adjacent to the surface of the toner container to be attached by the hot-melt means, with the surface of the element provided with the roller.

14. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein, before the heating step, the process further comprises the step of attaching a heating element, at least partly on the surface of the toner container to be attached by the hot-melt means, with the surface of the element provided with the roller.

15. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein, before the heating step, the process further comprises the step of attaching a heating element adjacent to the surface of the element provided with the roller to be attached by the hot-melt means, with the surface of the toner container.

16. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein, before the heating step, the process further comprises the step of attaching a heating element, at least partly on the surface of the element provided with the roller to be attached by the hot-melt means, with the surface of the toner container.

17. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein, before the heating step, the process further comprises the step of attaching a first heating element adjacent to the surface of the toner container to be attached by the hot-melt means, with the surface of the element provided with the roller, and a second heating element adjacent to the surface of the element provided with the roller to be attached by the hot-melt means with the surface of the toner container.

18. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein, before the heating step, the process further comprises the step of attaching a first heating element at least partly on the surface of the toner container to be attached by the hot-melt means with the surface of the element provided with the roller, and a second heating element at least partly on the surface of the element provided with the roller to be attached by the hot-melt means with the surface of the toner container.

19. A process for reconditioning a toner cartridge comprising at least a toner container with an opening for the passage of toner particles, remaining part of a sealing film and an element provided with a roller for the transfer of toner particles, said process comprising at least the step of:

separating the one from the other the toner cartridge and the element provided with the roller;

removing the remaining part of the sealing film;

attaching a sealing film on the toner container, said sealing film with a central strip intended to be torn off being a part of a sealing member which at least further comprises: a pulling member bound to the central strip, and means adapted to extend between a surface of the toner container and a surface of the element provided with the roller, said means being provided with hot-melt means, placing the element provided with the roller so that the hot-melt means of the sealing member extends between a surface of the toner container and a surface of the element provided with the roller;

heating the hot-melt means so as to at least soften the hot-melt means and pressing the surface of the toner cartridge on the surface of the element so as to press the hot-melt means between the said surfaces; and cooling the hot-melt means, at least during a part of said cooling, a pressure being maintained between the surface of the toner container and the surface of the element provided with the roller, wherein the toner cartridge to be reconditioned comprises a toner container attached to the element provided with the roller by a hot-melt means and in which the toner cartridge is provided with a heating element for at least softening the hot-melt means, the separating step of the toner container from the element being at least carried out by providing power to the heating element for softening the hot-melt means.

* * * * *